US007909588B2

(12) United States Patent
Czechowski et al.

(10) Patent No.: US 7,909,588 B2
(45) Date of Patent: Mar. 22, 2011

(54) MODULAR ROTOR ASSEMBLY

(75) Inventors: Edward S. Czechowski, Orchard Park, NY (US); Robert Small, Horseheads, NY (US); John R. Battershell, Hamburg, NY (US); Robert M. Kolodziej, Varysburg, NY (US)

(73) Assignee: Cameron International Corporation, Houston, TX (US)

( * ) Notice: Subject to any disclaimer, the term of this patent is extended or adjusted under 35 U.S.C. 154(b) by 636 days.

(21) Appl. No.: 10/889,146

(22) Filed: Jul. 12, 2004

(65) Prior Publication Data

US 2006/0008368 A1 Jan. 12, 2006

(51) Int. Cl.
*F04B 17/00* (2006.01)
*F16C 35/00* (2006.01)

(52) U.S. Cl. ..... 417/407; 417/423.12; 417/423.13; 384/462; 384/523

(58) Field of Classification Search ..... 417/410.4, 417/423.1, 407, 423.13, 423.12; 384/474, 384/317, 463, 523; 123/599.1, 559.1
See application file for complete search history.

(56) References Cited

U.S. PATENT DOCUMENTS 2,860,827 A * 11/1958 Egli ..... 415/164
3,174,680 A * 3/1965 Young ..... 416/174
3,555,962 A * 1/1971 Wolf et al. ..... 409/231
4,533,294 A * 8/1985 Onal ..... 415/119
4,541,740 A * 9/1985 Schard ..... 384/473
4,700,808 A * 10/1987 Haentjens ..... 184/6.18
5,007,504 A * 4/1991 Hallbach ..... 184/8
5,160,246 A * 11/1992 Horiuchi ..... 417/365
RE34,276 E * 6/1993 Glaser et al. ..... 417/407
5,425,345 A * 6/1995 Lawrence et al. ..... 123/559.1
5,443,054 A * 8/1995 Tateno et al. ..... 123/559.1
5,803,719 A * 9/1998 Ramsden et al. ..... 417/407
6,905,316 B2 * 6/2005 Parker et al. ..... 417/407
7,128,061 B2 * 10/2006 Middlebrook et al. .... 123/559.3
2002/0048517 A1 * 4/2002 Sugita et al. ..... 417/12
2002/0182055 A1 * 12/2002 Nagle ..... 415/111
2005/0287018 A1 * 12/2005 Mavrosakis ..... 417/407

OTHER PUBLICATIONS

Annular. (n.d.). Dictionary.com Unabridged (v 1.1). Retrieved Aug. 26, 2009, from Dictionary.com website: http://dictionary.reference.com/ browse/annular).*

* cited by examiner

*Primary Examiner* — Devon C Kramer
*Assistant Examiner* — Leonard J Weinstein
(74) *Attorney, Agent, or Firm* — Fletcher Yoder

(57) ABSTRACT

Portions of the drive system for a piece of rotating equipment are pre-assembled into a subassembly. The subassembly can be held together by a carrier that is fabricated to accept the components in a proper alignment so that the carrier can be installed as a unit. In one embodiment, the carrier becomes a gearbox housing component that is installed, saving the need for individual component alignment. This modular approach allows an assembly having a single part number to apply to a given compressor unit and further allows standardization of air ends of compressors with specific impellers and inlets added to meet requirements of a specific application.

6 Claims, 2 Drawing Sheets

MODULAR ROTOR ASSEMBLY

FIELD OF THE INVENTION

The field of this invention is modular pre-assembly of rotating components of industrial machinery and more specifically compressors.

BACKGROUND OF THE INVENTION

Typically, when an end user specifies a compression need from a manufacturer the manufacturer tries to provide a unit from an available product line to meet the performance and price parameters given. Since the potential applications and the specific parameters given by different users can vary, each unit may be specifically built for a unique application. For example, in a drive system, the final driven speed for a unit can vary. Generally, various components of the drive system to be installed in a gearbox have to be individually assembled and aligned with significant precision to prevent premature wear and failure. The assembly in the gearbox includes inner bearings and outer housings, a driven pinion/shaft, oil seals, an impeller to go into the gearbox housing with a gas seal around the shaft, associated bits and pieces of the oil lubrication system, and a shaft end cap and associated fittings.

Assembling these components for every unit is labor intensive and therefore expensive. It requires stocking of many options for given components that can be assembled together in only so many discrete ways. This requires greater costs for storage, proper inventory and, most of all, in assembly costs for a given unit.

Another costly issue is the need to precision fabricate all the components to facilitate the alignment procedure. The individual part tolerances can add up, making the ultimate alignment more difficult. A failure to properly control alignment can result in premature bearing, seal, or gear set wear. Manually assembling and aligning each unit can be a significant portion of the total labor cost.

SUMMARY OF THE INVENTION

There is provided a modular pre-assembly of some components of a drive into a carrier. In accordance with an embodiment of the present invention, a carrier is precision machined to accept drive components in an aligned condition to each other for quick assembly into the gearbox housing. Portions of the drive system for a piece of rotating equipment are pre-assembled into a subassembly. The subassembly can be held together by a carrier that is fabricated to accept the components in a proper alignment so that the carrier can be installed as a unit. In one embodiment, the carrier becomes a gearbox housing component that is installed, saving the need for individual component alignment. This modular approach allows an assembly having a single part number to apply to a given compressor unit and further allows standardization of air ends of compressors with specific impellers and inlets added to meet requirements of a specific application.

DETAILED DESCRIPTION OF THE PREFERRED EMBODIMENT

Figure 1:
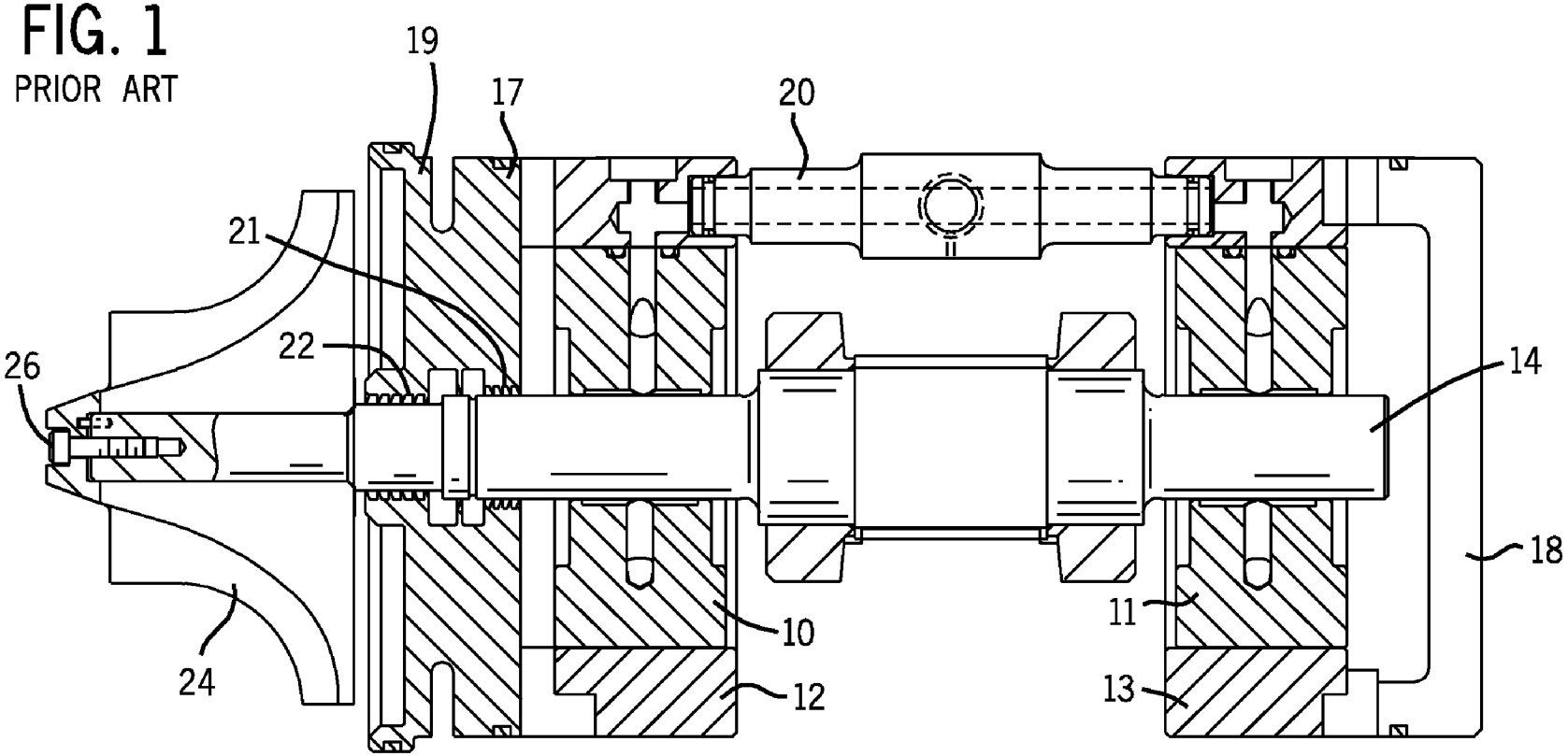
FIG. 1 PRIOR ART
FIG. 1 is the currently known way of assembling the components of the drive that requires significant time to insure proper component alignment.

FIG. 1 represents the known way to assemble the illustrated components. Inner bearings 10 and 11 and outer housings 12 and 13 are mounted on a gearbox or compressor housing. Generally, the gearbox housing is horizontally split and the mating halves have a semicircular cutout so that upon assembly, the bearings are respectively supported in the opposed gearbox housing walls. A geared pinion shaft 14 extends through bearings 10 and 11. An end cap 18 goes over the end of the shaft 14. Various piping manifolds 20, which are connected to each of the bearings 10 and 11, are illustrated. An oil seal 21 and a gas seal 22 are mounted to respective housings 17 and 19. The gearbox housing can be integrally cast in halves to form the gearbox lower and upper housings so that the assembly is completed around the housings 12 and 13 and housings 17 and 19. An impeller 24 is fitted to the end of the pinion shaft 14 and secured with a bolt 26, preferably through the open end of the scroll or gearbox housing. The stocking of these individual components and the custom combination of them to meet the requirements of a specific unit adds assembly, record keeping, and storage costs. The bearings 10 and 11 must be aligned to the pinion shaft 14 so as to maintain alignment of the gear meshes in the gearbox housing.

Figure 2:
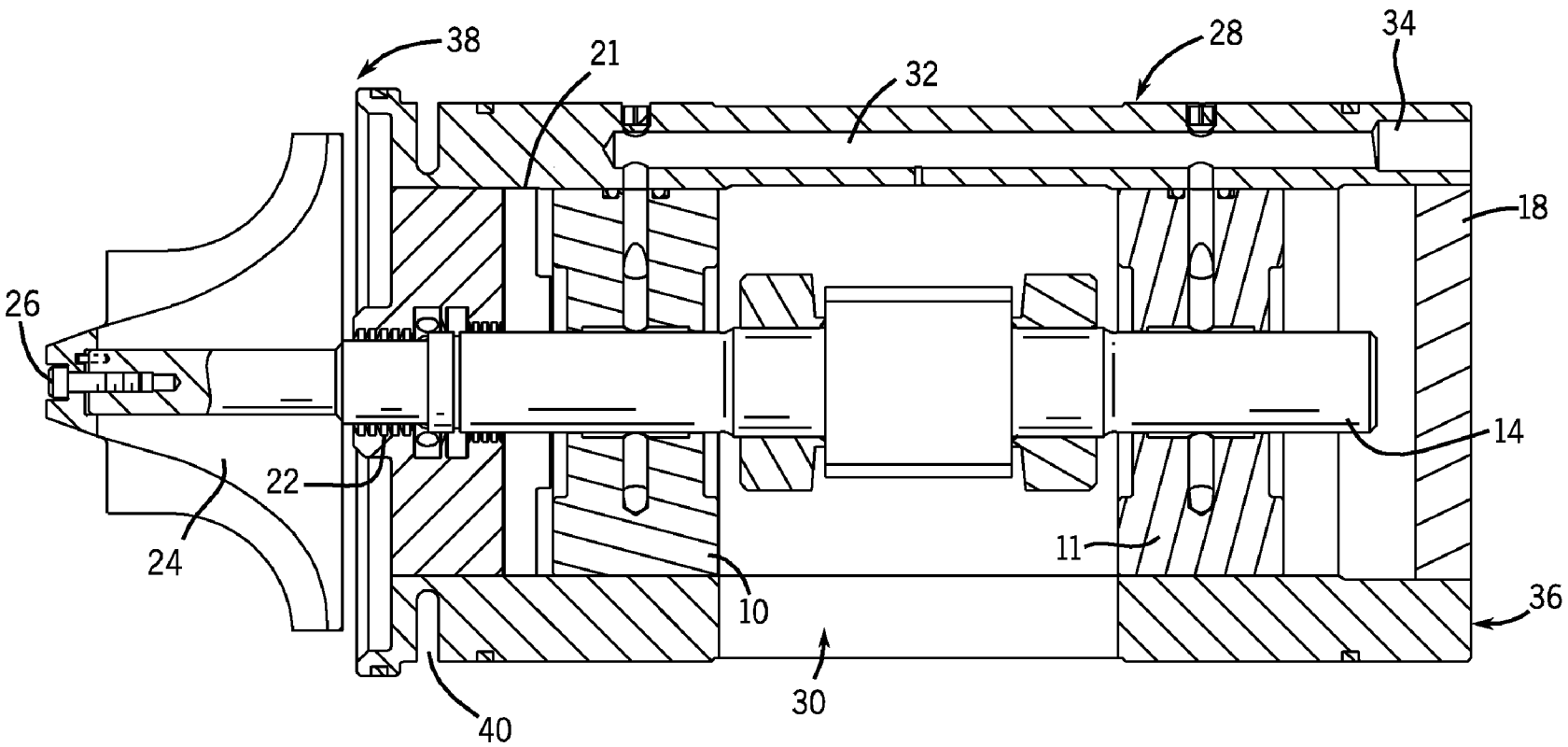
FIG. 2 shows the modular approach of the present invention where some of the drive components are pre-assembled into a carrier.

FIG. 2 illustrates the present invention. A one-piece carrier 28 holds the bearings 10 and 11, seals 21 and 22, end cap 18 and pinion 14. The carrier 28 has an opening to allow a bull gear (not shown) have access to mesh with the pinion 14. Oil passages 32 can be integrated into the carrier 28 and single or multiple end connections 34 can be provided at the end 36 of the carrier 28. A reconfigured end cap 18 is mounted at the end 36 of the carrier 28. Oil seal 21 is now within the carrier 28 while gas seal 22 is at end 38 of the carrier 28.

Those skilled in the art will appreciate that the components mounted to the carrier 28 are aligned by virtue of assembly to the precision machined carrier 28. The carrier 28 with the components mounted to it can be fitted to the lower part of the gearbox housing and scroll until the gas seal 22 is in a proper location as determined by alignment of groove 40 with an opening in the scroll or gearbox housing for insertion of a retaining Woodruff key or equivalent through the scroll or gearbox housing and into the groove 40. At that point the top of the gearbox housing and scroll can be mounted to complete the assembly shown in FIG. 2. The impeller 24 can be mounted to pinion shaft 14 either before or after the top halves of the gearbox housing and scroll are put on.

Those skilled in the art will appreciate that although the preferred embodiment illustrated is in the context of a centrifugal compressor, the illustrated pre-assembly technique can be used on a variety of rotating equipment applications and is applicable regardless of the size of the components or the horsepower of the connected driver. The pre-assembly technique can be applied to directly driven rotating equipment that does not employ a gearbox and a pinion such as 14. Configuring the carrier 28 to include oil passages 32 further speeds up the assembly process. The use of an alignment groove such as 40, which can take a variety of forms and does not need to extend circumferentially, also insures that the carrier 28 is properly positioned with respect to the gearbox and the impeller 24 in the surrounding scroll. The use of the carrier 28 assures alignment of the components mounted therein and reduces assembly time. The assembly can be stocked as a single part number and be warehoused pre-assembled. For a centrifugal compressor assembly, the assembled components in a carrier 28 allow the air end of the compressor to become a common assembly. That is, the impeller 24 and inlets (not shown) can be assembled locally to meet the requirements of a specific installation. The high level of alignment that can be obtained with the use of the carrier or cartridge will enhance the reliability of the rotating equipment and will provide additional hours of running time without maintenance or costly repairs. The cartridge concept is applicable on installations where there is a gearbox housing that serves as a base or in other applications where the base is a structure, such as when the drive is direct from driver to the shaft.

The foregoing disclosure and description of the invention are illustrative and explanatory thereof, and various changes in the size, shape and materials, as well as in the details of the illustrated construction, may be made without departing from the spirit of the invention.

We claim:

1. A subassembly for rotating equipment comprising:

a modular rotor assembly, comprising:

a one-piece carrier having a cylindrical exterior extending from a first end to a second end, a cylindrical interior extending from the first end toward the second end, a radial opening extending through the cylindrical interior and the cylindrical exterior between the first and second ends, an axial oil passage extending parallel to a longitudinal axis between the cylindrical exterior and the cylindrical interior, a first radial oil passage extending crosswise to the longitudinal axis from the axial oil passage through the cylindrical interior to a first bearing support region within the cylindrical interior, and a second radial oil passage extending crosswise to the longitudinal axis from the axial oil passage through the cylindrical interior to a second bearing support region within the cylindrical interior;

a first bearing at a first fixed position within the first bearing support region within the cylindrical interior;

a second bearing at a second fixed position within the second bearing support region within the cylindrical interior;

a shaft extending through the first and second bearings, wherein the shaft is configured to rotate about the longitudinal axis;

a gear coupled to the shaft, wherein the first and second fixed positions of the first and second bearings maintain alignment of the gear with the radial opening in the one-piece carrier; and an end plug disposed inside of the cylindrical interior at the first end, wherein the end plug seals the first end, and the shaft does not extend through the end plug.

2. The subassembly of claim 1, wherein the cylindrical exterior has a constant outer diameter from the first end to the second end.

3. The subassembly of claim 2, wherein the shaft is recessed inside of the first end, the shaft protrudes through the second end, and an impeller is coupled to the shaft at the second end.

4. The subassembly of claim 1, wherein the first and second radial oil passages are closed relative to the cylindrical exterior, and the axial oil passage extends through the first end at an end opening.

5. The subassembly of claim 1, wherein the axial oil passage has only one input opening configured to receive oil.

6. The subassembly of claim 1, wherein the first and second radial oil passages are perpendicular to the longitudinal axis, the cylindrical exterior has a constant outer diameter from the first end to the second end, and the axial oil passage is sealed relative to the cylindrical exterior.

* * * * *